US010875292B2

(12) United States Patent
Cohen et al.

(10) Patent No.: US 10,875,292 B2
(45) Date of Patent: Dec. 29, 2020

(54) DETECTING ARRIVAL OF INK IN A LIQUID INK PRINTING SYSTEM

(71) Applicant: HP INDIGO B.V., Amstelveen (NL)

(72) Inventors: Lavi Cohen, Ness Ziona (IL); Asaf Shoshani, Ness Ziona (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 16/493,970

(22) PCT Filed: Apr. 5, 2017

(86) PCT No.: PCT/EP2017/000429
§ 371 (c)(1),
(2) Date: Sep. 13, 2019

(87) PCT Pub. No.: WO2018/184648
PCT Pub. Date: Oct. 11, 2018

(65) Prior Publication Data
US 2020/0079075 A1 Mar. 12, 2020

(51) Int. Cl.
*G03G 15/08* (2006.01)
*B41F 31/02* (2006.01)

(52) U.S. Cl.
CPC ..... *B41F 31/022* (2013.01); *G03G 15/0858* (2013.01)

(58) Field of Classification Search
CPC ..... B41F 31/022; G03G 15/0858
See application file for complete search history.

(56) References Cited

U.S. PATENT DOCUMENTS

| | | | | |
|---|---|---|---|---|
| 5,533,449 | A | 7/1996 | Hasegawa et al. | |
| 6,246,841 | B1 * | 6/2001 | Merrifield | G03G 15/0856 399/113 |
| 6,405,008 | B1 | 6/2002 | Obu et al. | |
| 8,472,819 | B2 | 6/2013 | Chaplin et al. | |
| 2006/0260393 | A1 | 11/2006 | Takano | |
| 2007/0279441 | A1 | 12/2007 | Spohr et al. | |
| 2009/0322808 | A1 | 12/2009 | Mitchell et al. | |

FOREIGN PATENT DOCUMENTS

| | | |
|---|---|---|
| EP | 0923007 | 6/1999 |
| JP | 2005316034 A | 11/2005 |
| JP | 2014109653 | 6/2014 |
| KR | 1020060121468 | 11/2006 |

* cited by examiner

*Primary Examiner* — Arlene Heredia
(74) *Attorney, Agent, or Firm* — Dierker & Kavanaugh PC

(57) ABSTRACT

An example printing system for printing liquid ink has a developer device to transfer ink to an image plate of the printing system. The developer device has an ink inlet to receive ink from an ink reservoir of the printing system; a developer roller to transfer ink to the image plate, a motor to rotate the developer roller, and an ink sensor to detect arrival of ink at the developer device. The printing system is configured to start the motor in response to the ink sensor detecting arrival of ink at the developer device.

15 Claims, 2 Drawing Sheets

DETECTING ARRIVAL OF INK IN A LIQUID INK PRINTING SYSTEM

BACKGROUND

Liquid ink printing systems establish an ink flow from an ink reservoir to a image plate. On the one hand, when starting up the printing system, it may take some time until the ink flow completely establishes throughout the printing system. On the other hand, e.g. in an idle mode of the printing system, the ink may stop flowing and ink remaining in the system may dry.

BRIEF DESCRIPTION OF THE DRAWINGS

Examples will be described, by way of example only, with reference to the accompanying drawings in which corresponding reference numerals indicate corresponding parts and in which.

Figure 1:
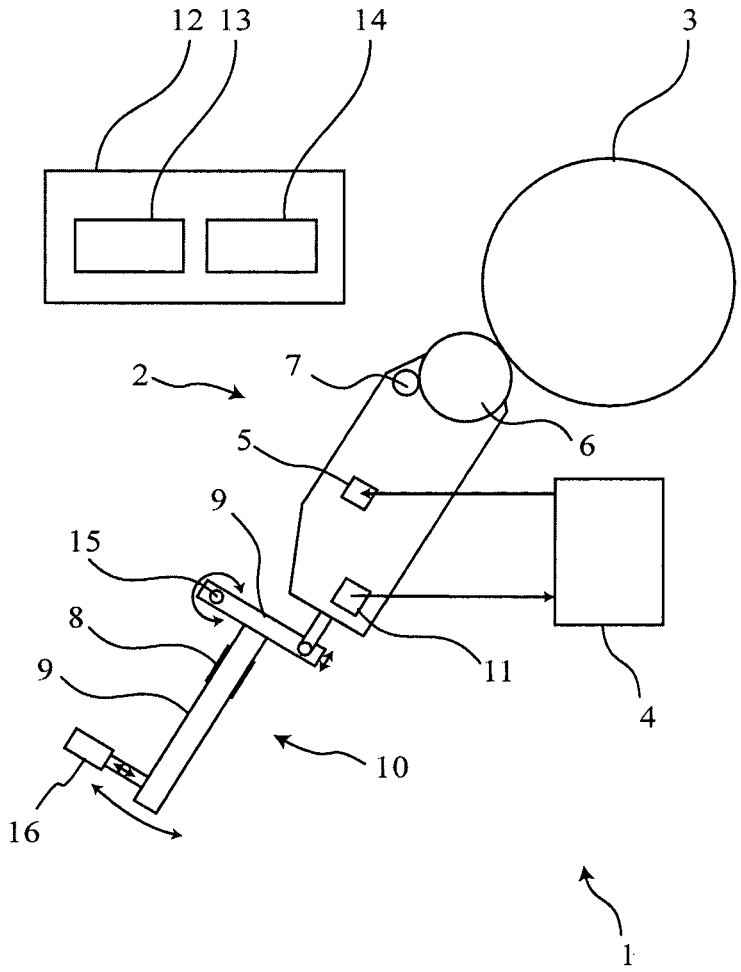
FIG. 1 is a schematic illustration of an example printing system with an example developer device and an example controller device.

Moreover the drawings provide examples and/or implementations consistent with the description; however, the description is not limited to the examples and/or implementations provided in the drawings.

DETAILED DESCRIPTION

The description refers to a printing system for printing liquid ink, which system has a developer device. The description further refers to the developer device, to a controller device to control the printing system and/or the developer device and to a method of operating the printing system and/or the developer device.

An example printing system for printing liquid ink has a developer device to transfer ink to an image plate of the printing system. The printing system further has an ink reservoir for liquid ink. The developer device has an ink inlet to receive ink from the ink reservoir, a developer roller to transfer ink to the image plate, a motor to rotate the developer roller, and an ink sensor to detect arrival of ink at the developer device. The printing system is configured to start the motor in response to the ink sensor detecting arrival of ink at the developer device.

An example developer device for a printing system has an ink inlet to receive ink from an ink reservoir of the printing system. The developer device further has a developer roller to transfer ink to an image plate of the printing system, a motor to rotate the developer roller, and an ink sensor to detect arrival of ink at the developer device. The developer device is configured to start the motor in response to the ink sensor detecting arrival of ink.

An example method pertains to operating the printing system and/or a developer device for printing liquid ink, wherein the printing system has a developer device to transfer ink to an image plate of the printing system, and an ink reservoir for liquid ink. The developer device has an ink inlet to receive ink from the ink reservoir; a roller to transfer ink to the image plate, a motor to rotate the developer roller, and an ink sensor. The example method of operating the printing system includes detecting, by the ink sensor, arrival of ink at the developer device, and starting the motor in response to detecting arrival of ink.

An example controller device to control the example printing system and/or the example developer device has a processor and a memory. The memory includes executable instructions that when executed by the processor cause the motor to rotate the developer roller in response to the ink sensor detecting arrival of ink.

Running the developer device with no ink in it (dry run) may increase wear of the developer device's components, e.g. of the developer roller, a sponge roller and/or seals. A dry run may also cause safety issues such as ignition due to high friction and rising temperatures. The duration of dry run can be reduced in that the motor, which drives the developer roller, is started in response to the ink sensor detecting arrival of ink at the developer device.

The ink sensor is configured to detect (the moment) when ink arrives at the developer device. For example, when initializing the printing system, e.g. after cleaning the printing system or after having rested the printing system in an idle mode, (fresh) ink is pumped from the ink reservoir to the developer device. It may take a certain amount of time until the ink reaches the developer device, for example 2, 4, 6, 8 or 10 seconds or even longer. This amount of time may depend on, e.g. a distance between the ink reservoir and the developer device, a power capability of the pump for pumping the ink, a viscosity and/or temperature of the ink and/or a diameter of an ink path from the ink reservoir to the developer device. In that, in some examples, the ink sensor is arranged at the developer device, the ink sensor allows for detecting (the moment of) arrival of ink independently from the time it takes the ink flowing from the reservoir to the developer device. This can reduce dry run of the developer device, for example.

In some examples, liquid ink can be printed on a print medium, e.g. as follows. Uniform static electric charge may be deposited on the image plate, which, for example, has a photoconductor surface. The image plate is arranged on a cylinder, for example. A latent image in the form of an invisible electrostatic charge pattern conforming to the image to be printed can be generated on the image plate by dissipating charge on the image plate by light exposure. For inking the image plate, i.e. transferring ink to the image plate, a developer device prepares a thin film of ink on a surface of its developer roller, for example. Electrical fields between the image plate and the developer roller result in attracting the ink to image areas and repelling it from the non-image area of the latent image on the image plate. This allows replicating the latent image with an inked image. In some examples, the inked image is transferred from the image plate to a blanket roller, which then transfers the inked image to the print medium.

In some examples, the ink includes carrier liquid and colorant particles. For example, the ink is a fluid electrophotographic ink. In some examples, the carrier liquid includes water, mineral oil and/or alcohol. In some examples, the colorant particles include colored resin particles.

In some examples, the developer device is a binary ink developer (BID), which is arranged for inking the image plate with a single (colored) ink at a time, e.g. black ink, cyan ink, yellow ink or magenta ink. The developer device is configured to receive any color of ink at the ink inlet. For example, the binary ink developer can be used with either black ink, cyan ink, yellow ink or magenta ink, or with spot color ink or with mixtures of inks.

In order to print multiple colors, some example printing systems have multiple developer devices, e.g. one developer device per color separation to be printed on a print medium. In some examples, multiple developer devices are arranged in series configured to ink the same image plate. For example, different color separations can be sequentially printed by the same image plate in that different ones of the multiple developer devices (each associated with a particular colored ink) sequentially engage and disengage the image plate. This allows for printing multiple color separations using one image plate and multiple developer devices.

In some examples, the developer device has an ink outlet to drain ink from the developer device. For example, superfluous ink, which has not been transferred to the image plate, can flow back to the ink reservoir via the ink outlet. In some examples, the ink flowing back to the ink reservoir is reconditioned, e.g. by adjusting a desired ratio of carrier liquid and colorant particles.

In some examples, the developer device has further rollers in addition to the developer roller, e.g. a squeegee roller to apply a thin film of ink to the developer roller, a cleaning roller to remove ink from the developer roller that has not been transferred to the image plate, a sponge roller to remove ink from the cleaning roller and/or a squeeze roller to remove ink from the sponge roller.

In some examples, the developer device has one or more rollers configured to establish an ink flow between the ink inlet and the ink outlet. For example, one or more rollers of the developer device are configured to pump (when rotated) ink from the ink inlet towards the developer roller and/or one or more rollers of the developer device are configured to pump (when rotated) ink from the developer roller, e.g. via a cleaner roller, towards the ink outlet. In these examples, the ink is circulated from the ink inlet towards the developer roller and/or from the developer roller to the ink outlet. In some of these examples, multiple of the rollers of the developer device are commonly driven by the motor of the developer device, which also drives the developer roller. In these examples, starting the motor of the developer device prevents from ink spilling out of the developer device as ink entering the developer device through the ink inlet and not being transferred to the image plate is pumped to the ink outlet.

In some examples, the ink sensor includes a flow sensor to detect an ink flow through the ink inlet. The flow sensor is located at the ink inlet or at an ink path between the ink inlet and the developer roller, for example. The flow sensor can detect arrival of ink at the developer device in that the flow sensor detects starting of an ink flow.

In some examples, the ink sensor includes a fill level sensor to detect an ink level in a cavity volume of the developer device. The fill level sensor can detect arrival of ink at the developer by detecting that an ink level in a cavity volume of the developer device changes from below to above a threshold fill level.

In some examples, the ink sensor includes a weight sensor to determine a weight of the developer device and/or change in weight of the developer device. The weight sensor can detect arrival of ink at the developer device by detecting an increase in weight of the developer device, since ink entering a cavity volume of the developer device increases a total weight of the developer device.

In some examples, the motor is stopped in response to the ink sensor detecting low ink at the developer device, e.g. to prevent the developer device from running with no ink (dry run). For example, detecting low ink includes detecting, by the flow sensor, that an ink flow through the ink inlet is stopped. For example, detecting low ink includes detecting, by the fill level sensor, that a fill level of ink in a cavity volume of the developer device drops below a threshold fill level. For example, detecting low ink includes detecting, by the weight sensor, a decrease in weight of the developer device.

In order to more reliably detect arrival of ink at the developer device, in some examples, the ink sensor output is compared with a threshold, e.g. to filter out sensor noise or fluctuations of the sensor signal, e.g. due to vibrations of the printing system. For example, arrival of ink is detected by the weight sensor in response to detecting an increase in weight higher than a threshold of, e.g. 1%, 5%, 10% or 30% of a maximum increase in weight, which corresponds to a maximum (possible) weight difference of the developer device being empty of ink and the developer device being fully filled with ink.

In some examples, the printing system has a supporting arm to carry the developer device. In some of these examples, the weight sensor includes one or more strain gauges arranged at the supporting arm. An increase in weight of the developer device increases a bending of the arm and induces a sensor signal in the strain gauge(s). In some other examples, the weight sensor includes a separate load cell to sense the weight of the developer device.

In some examples, the printing system has an engage device to engage and disengage the developer device with the image plate. In some examples, the printing system has multiple developer devices per image plate. In these examples, engaging different developer devices allows for transferring different (colored) ink to the image plate for printing multiple color separations on a print medium. For example, the supporting arm is a member of the engage device. In some examples, the supporting arm is connected with the printing system by a pivot joint to engage and disengage the developer device, in particular the developer roller, with the image plate.

In some examples, a weight of the developer device and/or a change in weight of the developer device is determined when the developer device is disengaged with the image plate. Monitoring the output of the strain gauge with the developer device not being engaged with the image plate allows for determining the developer device's weight in real time. In some examples, an engage force between the developer device and the image plate is detected by the weight sensor when the developer device is engaged with the image plate.

For example, the motor is started exactly when detecting arrival of ink at the developer device. In some examples the motor has a start-up time to reach its (final) operation speed. For example, the start-up time is 0.5, 1, 1.5 or 2 seconds.

It may take some time from the moment ink reaches the inlet until it reaches the developer roller and, in some examples, it may take some further time until the ink reaches the ink outlet. During this time(s) the developer device's weight gradually increases and the weight stabilizes on a steady-state weight when the developer device is fully loaded with ink, i.e. the developer devices ink cavity volume is completely filled up with ink.

In some examples, starting the motor includes to delayed start the motor in response to the ink sensor detecting arrival of ink. Starting the motor with a delay with respect to detecting arrival of ink allows for compensating the time it takes for the ink flowing from the ink inlet towards, e.g. the developer roller. For example, this reduces the duration of or prevents from the developer roller running dry until (newly arrived) ink reaches the developer roller. In some examples, delayed starting the motor includes a delay of e.g. 1, 2, 3, 4 or 5 seconds between detecting arrival of ink and starting the motor. In some examples, the delay between detecting arrival of ink and starting the motor is calculated based on the time it takes the ink to flow from the ink inlet to the developer roller. In some examples, additionally or alternatively the delay between detecting arrival of ink and starting the motor is based on the time needed for accelerating the motor to its operational speed.

In an idle mode of the printing system, ink remaining in the developer device may dry. In order to prevent ink from drying in the printing system, in some examples, ink is automatically drained from the developer device, e.g. through the ink outlet, when entering an idle mode of the printing system. In situations when the idle mode is left to re-start operation of the printing system, the detecting of ink arrival at the developer device reduces the duration of a dry run of the developer device while the ink is on its way from e.g. an ink reservoir, to the developer device, for example.

Now turning to FIG. 1, which schematically illustrates an example printing system 1. For example, the printing system 1 is for printing electrophotographic liquid ink, which is a suspension of colored resin particles and carrier liquid. The liquid ink is provided by an ink reservoir 4. The printing system 1 has a developer device 2 to transfer ink to an image plate 3 of the printing system 1. The image plate 3 has the form of a cylinder and has a photoconductive surface. For example, by one or multiple lasers, e.g. laser diodes, a latent image in the form of an invisible electrostatic charge pattern conforming to an image to be printed can be generated on the (previously uniformly electrically charged) image plate 3.

For inking the image plate 3, the developer device 2 has a developer roller 6 to transfer ink to the image plate 3. The developer device 2 prepares, e.g. by the help of other rollers of the developer device 2, for example the squeegee roller, a thin film of ink on the surface of its developer roller 6. The ink has concentration of about 3% solids when arriving at the ink inlet 5, for example. The developer device 2 is configured for performing a development within an operating of the printing system 1, wherein the development includes, for example, increasing the concentration of solids. For example, the thin film of ink on the surface of the developer roller 6 has a concentration of about 20% solids.

For rotating the developer roller 6 (and also the other rollers of the developer device 2), the developer device 2 includes an electrical motor 7. For transferring ink to the image plate 3, the printing system 1 rotates the cylindrical image plate 3 (by a motor separate from the motor 7 of the developer device 2). For transferring ink, also the developer roller 6 is rotated (by motor 7). Furthermore, the printing system 1 engages the developer device 2 with the image plate 3 using an engage device 10. The engage device 10 has a support arm 9 to carry the developer device 2. The arm 9 is mounted at the printing system 1 by a pivot joint 15, which allows to rotate the arm 9 by an actuator 16. As indicated by arrows in FIG. 1, the developer device 2 can be engaged with and disengaged from the image plate 3 by rotating the arm 9 by extending and retracting the actuator 16.

In the printing system 1, electrical fields between the image plate 3 and the developer roller 6 attract the ink from the developer roller 6 to image areas and repelling it from non-image areas of the latent image on the image plate 3. This allows replicating the latent image with an inked image on the image plate 3. The inked image is transferred from the image plate 3 to a blanket roller, which transfers the inked image to a print medium.

The developer device 2 receives liquid ink by an ink inlet 5 from the ink reservoir 4. For example, an ink pump is pumping liquid ink from the ink reservoir 4 to the developer device 2. However, in situations, e.g. after an idle mode of the printing system 1, when an ink path from the reservoir 4 to the developer device 2 is empty of ink, it takes some time after turning on the ink pump until ink arrives at the developer device 2. For example, the pump is started, when initializing the printing system 1. In order to prevent the developer device 2 from dry run, the printing system 1 is configured to start the motor 7 in response to detecting arrival of ink at the developer device 2 with an ink sensor 8. Since the motor 7 is started when the ink arrives at the developer device 2 (rather than when the ink pump starts operation), the developer device 2 is prevented from dry run while the ink is on its way from the ink reservoir 4 to the developer device 2 but has not yet reached the developer device 2.

In the printing system 1 shown by FIG. 1, the ink sensor 8 is a weight sensor to determine a weight and/or a change in weight of the developer device 2. The weight sensor has strain gauges 8 applied to the supporting arm 9, which carries the developer device 2. When ink arrives at the developer device 2, the developer device 2 begins filling up with ink. This increases a total weight of the developer device 2, since the weight of the ink pumped into the developer device 2 adds up with the weight of the (empty) developer device 2. The strain gauges 8 are connected as a Wheatstone-Bridge in order to highly sensitive detect any increase or decrease of the weight of the developer device 2. Thereby, the weight sensor 8 detects the arrival of ink by detecting an increase in weight of the developer device 2. Detecting arrival of ink by the weight sensor 8 is performed when the developer device 2 is disengaged from the image plate 3, for example.

The weight sensor 8 further enables the printing system 1 to determine engagement forces between the developer device 2 and the image plate 3. If the developer device 2 is engaged with the image plate 3, the weight sensor 8 senses both the developer device's weight and the engagement forces. Since the weight of the developer device 2 can be determined with the developer device 2 being disengaged from the image plate 3, the engagement forces can be determined.

In some examples, the printing system starts the motor 7 exactly at the moment the arrival of ink at the developer device is detected. For example, the motor 7 takes some time to speed up to its operational speed, the ink just in time arrives at the developer roller 6. Therefore, starting the motor 7 when the ink arrives at the developer device 2, prevents from dry run the developer device 2 while the ink is on its way from the ink reservoir 4 to the developer device 2.

Since in some examples, the developer device 2 has a relevant internal ink cavity volume, a certain amount of ink may flow through the ink inlet 5 until the ink reaches the developer roller 6. This may take some relevant time. Therefore, in some examples, the printing system 1 starts the motor 7 delayed in response to the ink sensor 8 detecting arrival of ink. This prevents the developer roller 6 from dry run while the ink is filling up the internal ink cavity volume of the developer device 2.

As described before, when transferring ink from the developer roller 6 to the image plate 3, non-image areas of the latent image on the image plate 3 repel ink. Therefore, not transferred ink, i.e. un-used ink can remain on the developer roller 6. In some examples, this un-used ink (e.g. about 20% solids concentration, e.g. resin, pigments, charge director etc.) is mixed with fresh ink (e.g. about 3% solids concentration), which freshly arrives via the ink inlet 5. In some other examples, a portion of un-used ink is mixed with fresh ink and a remaining portion or, for example, all of the un-used ink is spilled out via an ink outlet 11 of the developer device 2. In some examples, about 70%-90% of the ink received at the ink inlet 5 are guided to a gap between the developer roller 6 and electrodes, and the remaining 10%-30% of the ink are guided to the cleaner roller. This allows for mixing fresh ink with un-used ink at the cleaner roller, which improves cleaning the cleaning roller, for example.

In some example printing systems, the un-used ink flows back to the ink reservoir 4, for example. In some examples, the un-used ink is reconditioned by the printing system 1 before it is transferred back to the ink reservoir 4.

The printing system 1 can, e.g. automatically, drain ink from the developer device 2, e.g. when switching the printing system 1 to an idle state. This prevents from the ink drying inside the developer device 2, for example.

In some examples, the developer device 2 has one or more rollers to establish an ink flow between the ink inlet 5 and the developer roller 6 and/or between the developer roller 6 and the ink outlet 11 of the developer device 2. These rollers are also driven by the motor 7, for example.

FIG. 1 further schematically illustrates a controller device 12 to control the printing system 1 and/or the developer device 2. The controller device 12 has a processor 13 and a memory 14. The memory 14 stores executable instructions that when executed by the processor 13 cause the motor 7 to rotate the developer roller 6 in response to the ink sensor 8 detecting arrival of ink at the developer device 2.

Figure 2A:
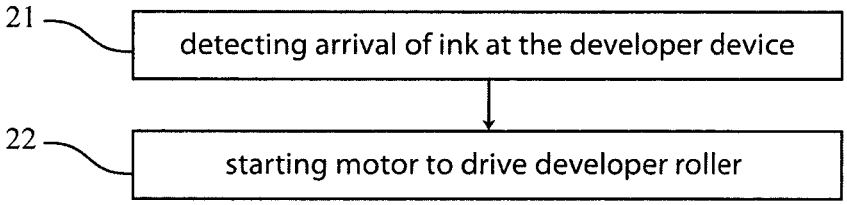
FIG. 2*a* shows a block diagram of an example method of operating the printing system and/or developer device of FIG. 1.

FIG. 2*a* illustrates schematically an example method of operating the printing system 1 and/or of operating the developer device 2 of FIG. 1. The example method includes detecting in block 21, by the ink sensor 8, an arrival of ink at the developer device 2. The method further includes starting in block 22 the motor 7 in response to detecting arrival of ink.

Figure 2B:
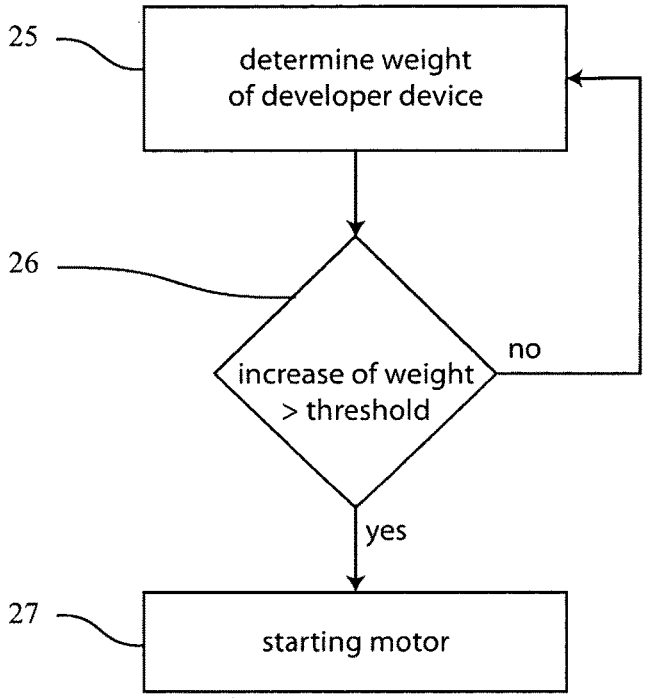
FIG. 2*b* shows a block diagram of an example method of operating the printing system and/or developer device of FIG. 1 with a weight sensor to detect arrival of ink at the developer device.

FIG. 2*b* illustrates schematically an example method of operating the printing system 1 and/or of operating the developer device 2 of FIG. 1 based on the method according to FIG. 2*a*. In the example illustrated in FIG. 2*b*, the ink sensor 8 is a weight sensor 8. The weight sensor 8 determines, in block 25, the weight of the developer device 2. When ink arrives at the ink inlet 5 at the not (yet) completely filled up developer device 2, the arriving ink increases the weight of the developer device 2. Detecting the arrival of ink includes determining, at block 26, whether an increase of weight of the developer device 2 exceeds a threshold. The increase of weight is a change in weight of the developer device 2 caused by the developer device 2 receiving ink through the ink inlet 5. For example, the increase of weight is determined based on a difference between a currently measured weight of the developer device 2 and the weight of the empty developer device 2, i.e. the weight of the developer device 2 determined with the developer device 2 including no ink. For example, the threshold is about 1%, 5%, 10% or 30% of a maximum increase in weight, which corresponds to a maximum (possible) weight difference of the developer device 2 being empty of ink and the developer device 2 being fully filled up with ink. In response to determining that the increase of weight exceeds the threshold, the motor 7 of the developer device 2 is started in block 27. For example, this prevents from starting the motor 7 with no ink in the developer device 2 and, thereby, reduces wear of the developer device's components, e.g. wear of the developer roller 6.

Figure 3:
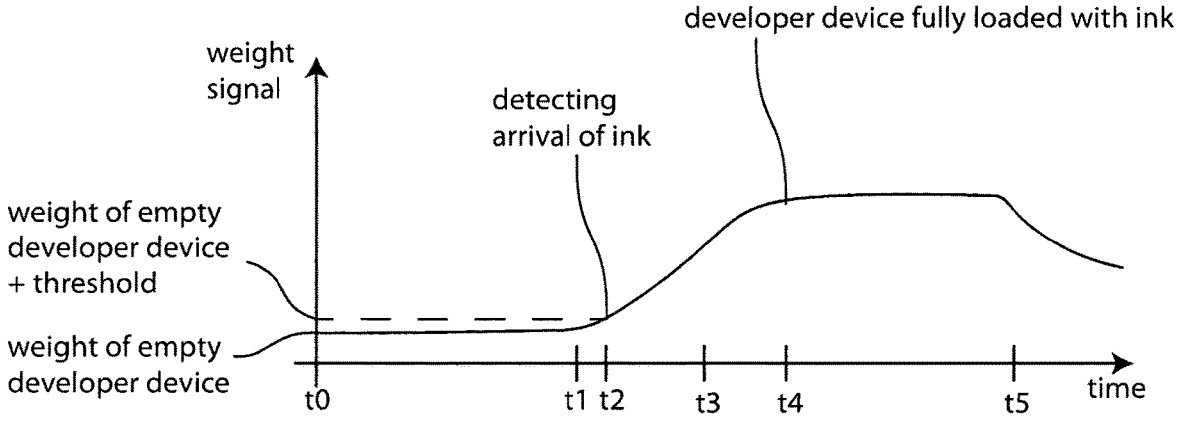
FIG. 3 is a schematic illustration of a weight signal of the weight sensor.

FIG. 3 illustrates schematically an example of detecting arrival of ink by the weight sensor 8 described in FIGS. 1 and 2*b*, wherein the weight signal of the weight sensor 8 is plotted over time. At times earlier than t1, the developer device 2 does not yet include any ink; it is empty of ink. The weight signal at times before time t1 corresponds to the weight of the (empty) developer device 2. At time to, the pump of the printing system 1 is started and begins pumping ink from the ink reservoir 4 to the developer device 2. Between times to and t1, the ink travels towards the developer device 2. At time t1, ink starts entering the developer device 2 through the ink inlet 5 and, thus, the weight signal increases. At time t2, the weight of the developer device 2, i.e. the sum of the weights of the empty developer device 2 and the ink so far entered the developer device 2) exceeds a threshold. The increase of weight exceeding the threshold triggers the weight sensor 8 to detect arrival of ink. Detecting arrival of ink based on comparing the increase of weight with a threshold reduces the risk of falsely detecting arrival of ink, e.g. caused by vibrations of the printing system 1 leading to noise when determining the weight of the developer device 2.

Between times t1 and t4 the weight signal continuously increases as the developer device 2 fills up with ink. At time t4, the weight signal shows the beginning of a plateau, which means that the developer device 2 is completely filled up (fully loaded) with ink. Additional ink still further being pumped into the ink inlet 5 is transferred to the image plate 3 or exits the developer device 2, e.g. through the ink outlet 11. Thus, the total weight of the developer device 2 and the ink present in (the cavity volume of) the developer device 2 does not further increase and results in the plateau.

As described before, in some examples, the printing system 1 starts the motor 7 (exactly at the moment t2) when ink arrival is detected. In some other examples, the printing system 1 starts the motor 7 with a delay (e.g. at time t3 delayed to time t2) after having detected arrival of ink to ensure that the ink has yet or almost yet reached the developer roller 6.

Dry run may also occur in other situations than initializing the printing system 1, e.g. in the case of a pump failure. In order to prevent the developer device 2 from dry run, the printing system 1, e.g. automatically, stops the motor 7 in response to the ink sensor 8 detecting low ink at the developer device 2. Such a situation is reflected by FIG. 3 at time t5 at which the weight signal begins decreasing. The printing system 1 stops the motor 7 in response to detect a decrease in weight of the developer device 2 at time t5.

Although some examples of methods and products have been described herein, other variations are generally within the scope of this description. As will be appreciated, the description generally contemplates various implementations fairly falling within the scope of the appended claims either literally or under the doctrine of equivalents.

The invention claimed is:

1. A printing system for printing liquid ink, the printing system comprising:

a developer device to transfer ink to an image plate of the printing system; and an ink reservoir for liquid ink;

wherein the developer device comprises:

an ink inlet to receive ink from the ink reservoir;

a developer roller to transfer ink to the image plate,
a motor to rotate the developer roller, and
an ink sensor to detect beginning a flow of ink into the developer device;

the printing system to start the motor in response to the ink sensor detecting beginning the flow of ink into the developer device.

2. The printing system according to claim 1, wherein the ink is a fluid electrophotographic ink comprising carrier liquid and colorant particles.

3. The printing system according to claim 1, the printing system to stop the motor in response to the ink sensor detecting a low ink level at the developer device.

4. The printing system according to claim 1, wherein starting the motor in response to the ink sensor detecting beginning a flow of ink into the developer device comprises delayed start the motor in response to the ink sensor detecting beginning a flow of ink into the developer device.

5. The printing system according to claim 1, wherein the developer device comprises an ink outlet to drain ink from the developer device.

6. The printing system according to claim 1, the printing system to automatically drain the ink from the developer device when entering an idle mode of the printing system.

7. A controller device to control a printing system according to claim 1, the controller device comprising a processor and a memory, the memory comprises executable instructions that when executed by the processor cause the motor to rotate the developer roller in response to the ink sensor detecting beginning a flow of ink into the developer device.

8. A printing system for printing liquid ink, the printing system comprising:

a developer device to transfer ink to an image plate of the printing system; and an ink reservoir for liquid ink; wherein the developer device comprises:

an ink inlet to receive ink from the ink reservoir;
a developer roller to transfer ink to the image plate,
a motor to rotate the developer roller, and
an ink sensor comprising a weight sensor to determine a change in weight of the developer device to detect beginning a flow of ink into the developer device, the printing system to start the motor in response to the ink sensor detecting beginning a flow of ink into the developer device.

9. The printing system according to claim 8, wherein the printing system comprises a supporting arm to carry the developer device, wherein the weight sensor comprises a strain gauge arranged at the supporting arm.

10. The printing system according to claim 8, wherein the printing system comprises an engage device to engage and disengage the developer device with the image plate and the system to determine a change in weight of the developer device when the developer device is disengaged with the image plate.

11. A developer device for a printing system for printing liquid ink, the developer device comprising:

an ink inlet to receive ink from a ink reservoir of the printing system,
a developer roller to transfer ink to an image plate of the printing system,
a motor to rotate the developer roller, and
an ink sensor to detect beginning a flow of ink into the developer device;
wherein the motor is to start in response to the ink sensor detecting beginning a flow of ink into the developer device.

12. A method of operating a printing system for printing liquid ink;

wherein the printing system comprises a developer device to transfer ink to an image plate of the printing system, and an ink reservoir for liquid ink;

wherein the developer device comprises an ink inlet to receive ink from the ink reservoir, a developer roller to transfer ink to the image plate, a motor to rotate the developer roller, and an ink sensor; and wherein the method comprises:

detecting, by the ink sensor, beginning a flow of ink into the developer device; and
starting the motor in response to detecting beginning a flow of ink into the developer device.

13. The method of operating the printing system according to claim 12, wherein the ink sensor comprises a weight sensor to determine a weight of the developer device, and wherein detecting beginning a flow of ink into the developer device comprises detecting an increase of weight of the developer device.

14. The method of operating the printing system according to claim 12, wherein starting the motor in response to detecting beginning a flow of ink into the developer device comprises delayed starting the developer motor.

15. The method of operating the printing system according to claim 12, the method further comprising stopping the motor in response to detecting a low ink level at the developer device.

* * * * *